US005681678A

United States Patent [19]

Nealey et al.

[11] Patent Number: 5,681,678

[45] Date of Patent: Oct. 28, 1997

[54] CHARGE GENERATION LAYER CONTAINING HYDROXYALKYL ACRYLATE REACTION PRODUCT

[75] Inventors: Richard H. Nealey, Penfield; Martha J. Stegbauer, Ontario, both of N.Y.

[73] Assignee: Xerox Corporation, Stamford, Conn.

[21] Appl. No.: 786,009

[22] Filed: Jan. 21, 1997

[51] Int. Cl.[6] ..... G03G 5/047

[52] U.S. Cl. ..... 430/58; 430/59; 430/96

[58] Field of Search ..... 430/58, 96

[56] References Cited

U.S. PATENT DOCUMENTS

| | | | |
|---|---|---|---|
| 3,121,006 | 2/1964 | Middleton et al. | 430/31 |
| 3,481,735 | 12/1969 | Graver et al. | 430/96 |
| 3,649,263 | 3/1972 | Tubuko et al. | 430/96 |
| 3,793,021 | 2/1974 | Yamaguchi et al. | 430/96 |
| 4,265,990 | 5/1981 | Stolka et al. | 430/59 |
| 4,728,592 | 3/1988 | Ohaku et al. | 430/59 |
| 4,898,799 | 2/1990 | Fujimaki et al. | 430/59 |
| 5,322,755 | 6/1994 | Allen et al. | 430/96 |
| 5,418,107 | 5/1995 | Nealey et al. | 430/132 |
| 5,521,306 | 5/1996 | Burt et al. | 540/141 |

FOREIGN PATENT DOCUMENTS

| | | | |
|---|---|---|---|
| 63-316056 | 12/1988 | Japan | 430/96 |

*Primary Examiner*—Roland Martin

[57] ABSTRACT

An electrophotographic imaging member including a substrate, a charge generating layer and a charge transport layer, the charge generating layer comprising photoconductive hydroxygallium phthalocyanine particles dispersed in a polymer matrix, the matrix comprising a polymeric film forming reaction product of at least vinyl chloride, vinyl acetate and hydroxyalkyl acrylate.

18 Claims, No Drawings

CHARGE GENERATION LAYER CONTAINING HYDROXYALKYL ACRYLATE REACTION PRODUCT

BACKGROUND OF THE INVENTION

This invention relates in general to electrophotographic imaging members and more specifically, to an electrophotographic imaging member having an improved charge generation layer.

In the art of electrophotography an electrophotographic plate comprising a photoconductive insulating layer on a conductive layer is imaged by first uniformly electrostatically charging the imaging surface of the photoconductive insulating layer. The plate is then exposed to a pattern of activating electromagnetic radiation such as light, which selectively dissipates the charge in the illuminated areas of the photoconductive insulating layer while leaving behind an electrostatic latent image in the non-illuminated area. This electrostatic latent image may then be developed to form a visible image by depositing finely divided electroscopic toner particles on the surface of the photoconductive insulating layer. The resulting visible toner image can be transferred to a suitable receiving member such as paper. This imaging process may be repeated many times with reusable electrophotographic imaging members.

The electrophotographic imaging members may be in the form of plates, drums or flexible belts. These electrophotographic members are usually multilayered photoreceptors that comprise a substrate, a conductive layer, an optional hole blocking layer, an optional adhesive layer, a charge generating layer, and a charge transport layer, an optional overcoating layer and, in some belt embodiments, an anticurl backing layer.

A conventional technique for coating cylindrical or drum shaped photoreceptor substrates involves dipping the substrates in coating baths. The bath used for preparing photoconducting layers is prepared by dispersing photoconductive pigment particles in a solvent solution of a film forming binder. Unfortunately, some organic photoconductive pigment particles cannot be applied by dip coating to form high quality photoconductive coatings. For example, organic photoconductive pigment particles such as hydroxygallium phthalocyanine pigment particles tend to settle when attempts are made to disperse the pigments in a solvent solution of a film forming binder. The tendency of the particles to settle requires constant stirring which can lead to entrapment of air bubbles that are carried over into the final photoconductive coating deposited on a photoreceptor substrate. These bubbles cause defects in final prints xerographically formed with the photoreceptor. The defects are caused by differences in discharge of the electrically charged photoreceptor between the region where the bubbles are present and where the bubbles are not present. Thus, for example, the final print will show dark areas over the bubbles during discharged area development or white spots when utilizing charged area development. Moreover, many pigment particles tend to agglomerate when attempts are made to disperse the pigments in solvent solutions of film forming binders. The pigment agglomerates lead to non-uniform photoconductive coatings which in turn lead to other print defects in the final xerographic prints due to non-uniform discharge. The film forming binder selected for photoconductive pigment particles in a charge generating layer can adversely affect the particle dispersion uniformity, coating composition rheology, residual voltage after erase and electrophotographic sensitivity. Some binders can lead to unstable pigment particle dispersions which are unsuitable for coating photoreceptors. Thus, for example, when a copolymer reaction product of 86 weight percent vinyl chloride and 14 weight percent vinyl acetate such as VYHH terpolymer from Union Carbide is utilized to disperse hydroxygallium phthalocyanine photoconductive particles, an unstable dispersion is obtained. Moreover, a charge generating layer containing this copolymer has poor light sensitivity and gives high residual voltage after erase. Combinations of some polymers can result in unacceptable coating or electrical properties. For example, some polymers are incompatible with each other and cannot form coatings in which the polymers or particles are distributed uniformly throughout the final coating.

Photoconductive compositions are also difficult to modify for electrophotographic copiers, duplicators and printers characterized by different sensitivity requirements. Thus, custom photogenerating layer compositions must be prepared for each type of machine having its own different specific sensitivity requirement. The addition of a relatively insensitive pigment to a highly sensitive photoconductive pigment can alter the overall sensitivity of a photoreceptor. However, uniform electrical characteristics from one batch to the next batch is difficult to achieve because of uneven pigment distribution of the two different pigment particles in the final dried charge generation layer. Variations in distribution might be due to property differences of the different pigment materials employed such as size, shape, wetting characteristics, density, triboelectric charge, and the like. For example, some dispersions behave in a non-uniform manner when deposited as a coating on a photoreceptor substrate to form discontinuous coatings during dip coating or roll coating operations. It is believed that these discontinuous coatings are caused by the coating material flowing in some regions of the areas being coated and not in other regions.

INFORMATION DISCLOSURE STATEMENT

U.S. Pat. No. 5,087,544 to Muto et al., issued Feb. 11, 1992—an electrophotosensitive material is disclosed comprising a conductive substrate, and a photosensitive layer provided on the conductive substrate and containing a m-phenylenediamine compound represented by a specified formula. The electrophotosensitive material has a high sensitivity and is easy to be manufactured. Various specific vinyl binders for the photosensitive layer are disclosed.

U.S. Pat. No. 4,925,759 to Hanatani et al, issued May 15, 1990—An electrophotographic sensitive material is provided which has a photosensitive layer formed on an electroconductive substrate, the photosensitive layer containing a pyrrolopyrrole type compound represented by a specified formula and a benzidine derivative represented by a specified formula. Various specific vinyl binders for the photosensitive layer are disclosed.

U.S. Pat. No. 5,223,364 to Maeda et al., issued Jun. 29, 1993—An electrophotographic photoconductor is disclosed which includes a conductive substrate and a photosensitive layer containing perylene pigment as a charge generating material formed on the conductive substrate. The X-ray diffraction peak of the perylene pigment exhibits its peak when the value of 20 is 140 (+0.30), and the half-width of the peak when the value of 20 is 140 (+0.30) is 0.5 or more. This electrophotographic photoconductor has excellent qualities of low residual potential and stabilized quality. Various specific vinyl binders for the photosensitive layer are disclosed.

U.S. Pat. No. 5,521,306 to Richard Burt et al., issued May 28, 1996—A process for preparation of Type V hydroxygallium phthalocyanine is disclosed comprising the in situ formation of an alkoxy-bridged gallium phthalocyanine dimer, hydrolyzing the dimer to hydroxygallium phthalocyanine and subsequently converting the hydroxygallium phthalocyanine product obtained to Type V hydroxygallium phthalocyanine.

U.S. Pat. No. 5,322,755 to Ah-Mee Hor et al, issued Jun. 21, 1994—An electrophotographic recording element is disclosed. In addition, some dispersions react non-uniformly when deposited as a coating on a photoreceptor substrate to form discontinuous coatings during dip coating or roll coating operations. It is believed that these discontinuous coatings are caused by the coating material flowing in some regions of the coating and not in other regions.

U.S. Pat. No. 5,418,107. to Richard Nealey et al., issued May 23, 1995—A process is disclosed for fabricating an electrophotographic imaging member including providing a substrate to be coated, forming a coating comprising photoconductive pigment particles having an average particle size of less than about 0.6 micrometer dispersed in a solution of a solvent comprising n-alkyl acetate having from 3 to 5 carbon atoms in the alkyl group and a film forming polymer consisting essentially of a film forming polymer having a polyvinyl butyral content between about 50 and about 75 mol percent, a polyvinyl alcohol content between about 12 and about 50 mol percent, and a polyvinyl acetate content is between about 0 to 15 mol percent, the photoconductive pigment particles including a mixture of at least two different phthalocyanine pigment particles free of vanadyl phthalocyanine pigment particles, drying the coating to remove substantially all of the alkyl acetate solvent to form a dried charge generation layer comprising between about 50 percent and about 90 percent by weight of the pigment particles based on the total weight of the dried charge generation layer, and forming a charge transport layer.

U.S. Pat. No. 5,114,815 to ODA et al, issued May 19, 1992—An electrophotographic photoreceptor is disclosed having a light-sensitive layer on an electroconductive base. The light-sensitive layer is formed from a dispersion in which a titanyl phthalocyanine having at least two predominant peaks at Bragg angle 2_ at 9.6°±0.2° and 27.2°±0.2° in a diffraction spectrum obtained with characteristic x-rays of Cu K at a wavelength of 1.54 Angstrom is dispersed in a dispersion medium that contains at least one of branched acetate ester and alcohol solvents as a chief component. Charge generation particle sizes having an average particle size of 2 micrometer or below, preferably 1 micrometer or below are also disclosed.

U.S. Pat. No. 4,728,592 to Ohaku et al., issued Mar. 1, 1988—An electrophotoconductor is disclosed having a light sensitive layer comprising a titanyl phthalocyanine dispersed in a binder, the titanyl phthalocyanine having a certain specified structure. The titanyl phthalocyanine may be employed in combination with a binder such as butyral resin.

U.S. Pat. No. 4,898,799 to Fujimaki et al., issued Feb. 6, 1990—A photoreceptor for electrophotography is disclosed containing a titanyl phthalocyanine compound which has certain specified major peaks in terms of Bragg's 2θ angles. The binders used to form the carrier generator layer may include polyvinyl butyral.

U.S. Pat. No. 4,265,990 to Stolka et al., issued May 5, 1981—A photosensitive member is disclosed having at least two electrically operative layers. The first layer comprises a photoconductive layer and the second layer comprises a charge transport layer. The charge transport layer comprises a polycarbonate resin and a diamine having a certain specified structure. Also, metal phthalocyanines are disclosed as useful as charge generators. A photoconductor particle size of about 0.01 to 5.0 micrometers is mentioned.

U.S. Pat. No. 3,121,006 to Middleton et al., issued Feb. 11, 1964—A xerographic process is disclosed which utilizes a xerographically sensitive member comprising an insulating organic binder having dispersed therein finely-divided particles of an inorganic photoconductive insulating metallic-ions containing crystalline compound. Various specific insulating organic binders are disclosed.

CROSS REFERENCE TO COPENDING PATENT APPLICATIONS

U.S. application Ser. No. 789,642, filed concurrently herewith in the names of R. Nealey et al., entitled "CHARGE GENERATION LAYER CONTAINING MIXTURE OF TERPOLYMER AND COPOLYMER"–An electrophotographic imaging member is disclosed comprising a substrate, a charge generating layer and a charge transport layer, said charge generating layer comprising photoconductive particles selected from the group consisting of hydroxygallium phthalocyanine particles and titanyl phthalocyanine particles dispersed in a polymer matrix, the matrix comprising a uniform mixture of a film forming terpolymer reaction product of vinyl chloride, vinyl acetate and maleic acid and a film forming copolymer reaction product of vinyl chloride and vinyl acetate.

As described above, there is a continuing need for versatile high quality photoreceptors.

SUMMARY OF THE INVENTION

It is, therefore, an object of the present invention to provide an improved photoreceptor which overcomes the above-noted deficiencies.

It is yet another object of the present invention to provide an improved photoreceptor have high quality photoconductive coatings.

It is still another object of the present invention to provide an improved photoreceptor that have uniform continuous photoconductive coatings.

It is another object of the present invention to provide an improved photoreceptor that exhibit improved electrical properties.

It is yet another object of the present invention to provide an improved more versatile tunable photoreceptor.

These and other objects of the present invention are accomplished by providing an electrophotographic imaging member comprising a substrate, a charge generating layer and a charge transport layer, the charge generating layer comprising photoconductive hydroxygallium phthalocyanine particles dispersed in a polymer matrix, the matrix comprising a polymeric film forming reaction product of at least vinyl chloride, vinyl acetate and hydroxyalkyl acrylate.

Electrophotographic imaging members, i.e. photoreceptors, are well known in the art. Typically, a substrate is provided having an electrically conductive surface. At least one photoconductive layer is then applied to the electrically conductive surface. A charge blocking layer may be applied to the electrically conductive surface prior to the application of the photoconductive layer. If desired, an adhesive layer may be utilized between the charge blocking layer and the photoconductive layer. For multilayered photoreceptors, a charge generation binder layer is usually applied onto the blocking layer and charge transport layer is formed on the charge generation layer. However, if desired, the charge generation layer may be applied to the charge transport layer.

The substrate may be opaque or substantially transparent and may comprise numerous suitable materials having the required mechanical properties. Accordingly, the substrate may comprise a layer of an electrically non-conductive or conductive material such as an inorganic or an organic composition. As electrically non-conducting materials there may be employed various resins known for this purpose including polyesters, polycarbonates, polyamides, polyurethanes, and the like which are rigid or flexible, such as thin webs.

The thickness of the substrate layer depends on numerous factors, including beam strength and economical considerations, and thus this layer for a flexible belt may be of substantial thickness, for example, about 125 micrometers, or of minimum thickness less than 50 micrometers, provided there are no adverse effects on the final electrostatographic device. In one flexible belt embodiment, the thickness of this layer ranges from about 65 micrometers to about 150 micrometers, and preferably from about 75 micrometers to about 100 micrometers for optimum flexibility and minimum stretch when cycled around small diameter rollers, e.g. 19 millimeter diameter rollers. Substrates in the shape of a drum or cylinder may comprise a metal, plastic or combinations of metal and plastic of any suitable thickness depending upon the degree of rigidity desired.

The conductive layer may vary in thickness over substantially wide ranges depending on the optical transparency and degree of flexibility desired for the electrostatographic member. Accordingly, for a flexible photoresponsive imaging device, the thickness of the conductive layer may be between about 20 angstrom units to about 750 angstrom units, and more preferably from about 100 Angstrom units to about 200 angstrom units for an optimum combination of electrical conductivity, flexibility and light transmission. The flexible conductive layer may be an electrically conductive metal layer formed, for example, on the substrate by any suitable coating technique, such as a vacuum depositing technique. Where the substrate is metallic, such as a metal drum, the outer surface thereof is normally inherently electrically conductive and a separate electrically conductive layer need not be applied.

After formation of an electrically conductive surface, a hole blocking layer may be applied thereto. Generally, electron blocking layers for positively charged photoreceptors allow holes from the imaging surface of the photoreceptor to migrate toward the conductive layer. Any suitable blocking layer capable of forming an electronic barrier to holes between the adjacent photoconductive layer and the underlying conductive layer may be utilized. Blocking layers are well known and disclosed, for example, in U.S. Pat. Nos. 4,291,110, 4,338,387, 4,286,033 and 4,291,110. The disclosures of U.S. Pat. Nos. 4,338,387, 4,286,033 and 4,291,110 are incorporated therein in their entirety. The blocking layer may comprise an oxidized surface which inherently forms on the outer surface of most metal ground plane surfaces when exposed to air. The blocking layer may be applied as a coating by any suitable conventional technique such as spraying, dip coating, draw bar coating, gravure coating, silk screening, air knife coating, reverse roll coating, vacuum deposition, chemical treatment and the like. For convenience in obtaining thin layers, the blocking layers are preferably applied in the form of a dilute solution, with the solvent being removed after deposition of the coating by conventional techniques such as by vacuum, heating and the like. Drying of the deposited coating may be effected by any suitable conventional technique such as oven drying, infrared radiation drying, air drying and the like. The blocking layer should be continuous and have a thickness of less than about 2 micrometer because greater thicknesses may lead to undesirably high residual voltage.

An optional adhesive layer may applied to the hole blocking layer. Any suitable adhesive layer well known in the art may be utilized. Satisfactory results may be achieved with adhesive layer thickness between about 0.05 micrometer (500 angstroms) and about 0.3 micrometer (3,000 angstroms). Conventional techniques for applying an adhesive layer coating mixture to the charge blocking layer include spraying, dip coating, roll coating, wire wound rod coating, gravure coating, Bird applicator coating, and the like. Drying of the deposited coating may be effected by any suitable conventional technique such as oven drying, infra red radiation drying, air drying and the like.

In the photogenerating layer of this invention, photoconductive hydroxygallium phthalocyanine particles are dispersed in a polymer matrix, the matrix comprising a polymeric film forming reaction product of at least vinyl chloride, vinyl acetate and hydroxyalkyl acrylate. Photoconductive hydroxygallium phthalocyanine particles are well known in the art. These particles are available in numerous polymorphic forms. Any suitable hydroxygallium phthalocyanine polymorph may be used in the charge generating layer of the photoreceptor of this invention. Hydroxygallium phthalocyanine polymorphs are extensively described in the technical and patent literature. For example, hydroxygallium phthalocyanine Type V and other polymorphs are described in U.S. Pat. No. 5,521,306, the entire disclosure of this patent being incorporated herein by reference. Generally, the photoconductive pigment particle size utilized is less than the thickness of the dried charge generating layer and the average particle size is less than about 1 micrometer. Satisfactory results are achieved with an average photoconductive particle size of less than about 0.6 micrometer when the photoconductive coating is applied by dip coating. Preferably, the average photoconductive particle size is less than about 0.4 micrometer. Optimum results are achieved with an average particles size of less than about 0.1 micrometer.

The polymer matrix in the charge generating layer of this invention comprises a polymeric film forming reaction product of at least vinyl chloride, vinyl acetate and hydroxyalkyl acrylate. The film forming polymer is the reaction product of at least vinyl chloride, vinyl acetate and a hydroxyalkyl acrylate prepared using conventional emulsion or suspension polymerization techniques. The chain length can be controlled by varying the reaction temperature and time. For utilization in the photoconductive layer of this invention, one embodiment of the polymer may be formed from a reaction mixture comprising between about 80 percent and about 90 percent by weight vinyl chloride, between about 3 percent and about 15 percent by weight vinyl acetate and between about 6 percent and about 20 percent by hydroxyalkyl acrylate, based on the total weight of the reactants for the terpolymer.

This terpolymer may be represented by the following formula:

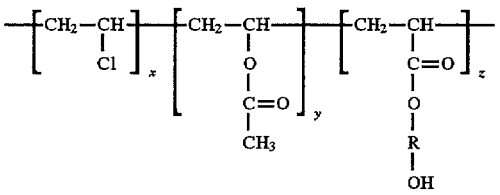

wherein

R is an alkyl group containing 2 to 3 carbon atoms, x is the proportion of the polymer derived from a reaction mixture comprising between about 80 percent and about 90 percent by weight vinyl chloride, y is the proportion of the polymer derived from a reaction mixture comprising between about 3 percent and about 15 percent by weight vinyl acetate, and z is the proportion of the polymer derived from a reaction mixture comprising between about 6 percent and about 20 percent by weight hydroxyalkyl acrylate, based on the total weight of the reactants for the terpolymer.

These film forming terpolymers are commercially available and include, for example, VAGF resin—a polymeric reaction product of 81 weight percent vinyl chloride, 4 weight percent vinyl acetate and 15 weight percent hydroxyalkyl acrylate having a weight average molecular weight of about 33,000 (available from Union Carbide Co.), (and the like. Satisfactory results may be achieved when the matrix terpolymer is a solvent soluble terpolymer having a weight average molecular weight of at least about 15,000. Preferably, these terpolymers have a weight average molecular weight of between about 15,000 and about 45,000. When the molecular weight is below about 35,000, poor film forming properties and undesirable dispersion characteristics can be encountered.

Instead of the terpolymer described above, the charge generating layer of this invention may comprise a polymeric film forming reaction product of vinyl chloride, vinyl acetate, hydroxyalkyl acrylate and maleic acid. These reactants may form the tetrapolymer with the final tetrapolymer containing a spine of carbon atoms. The tetrapolymer chain length can be controlled by varying the reaction temperature and time. For utilization in the photoconductive layer of this invention, this embodiment of the polymer may formed from a reaction mixture comprising between about 80 percent and about 90 percent by weight vinyl chloride, between about 3 percent and about 15 percent by weight vinyl acetate, between about 6 percent and about 20 percent by weight hydroxyalkyl acrylate and between about 0.25 percent and about 0.38 percent by weight of maleic acid based on the total weight of the reactants for the tetrapolymer.

The proportion of maleic acid present in the final polymer can vary from 0 weight percent to 0.38 weight percent without adversely affecting the quality of the dispersion or the coating quality.

The tetrapolymer may be represented by the following formula:

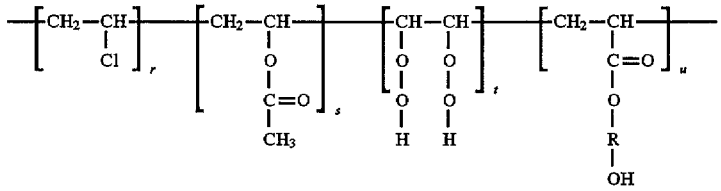

wherein

R is an alkyl group containing 2 to 3 carbon atoms, r is the proportion of the tetrapolymer derived from a reaction mixture comprising between about 80 percent and about 90 percent by weight vinyl chloride, s is the proportion of the tetrapolymer derived from a reaction mixture comprising between about 3 percent and about 15 percent by weight vinyl acetate, and t is the proportion of the tetrapolymer derived from a reaction mixture comprising up to 0.4 percent by weight maleic acid, and u is the proportion of the tetrapolymer derived from a reaction mixture comprising between about 6 percent and about 20 percent by weight hydroxyalkyl acrylate based on the total weight of the reactants for the tetrapolymer.

The film forming tetrapolymers of this embodiment are commercially available and include, for example, UCAR-Mag 527 resin—a polymeric reaction product of 81 weight percent vinyl chloride, 4 weight percent vinyl acetate, 15 weight percent hydroxyethyl acrylate, and 0.28 weight percent maleic acid having a weight average molecular weight of about 35,000 (available from Union Carbide Co.). Satisfactory results may be achieved when the tetrapolymer is a solvent soluble polymer having a weight average molecular weight of about 35,000. Preferably, these tetrapolymers have a weight average molecular weight of between about 20,000 and about 50,000. When the molecular weight is below about 20,000, poor film forming properties and undesirable dispersion characteristics can be encountered.

The alkyl component of the hydroxyalkyl acrylate reactant for the terpolymer or tetrapolymer described above contains from 2 to 3 carbon atoms and includes, for example, ethyl, propyl, and the like. A proportion of hydroxyalkyl acrylate reactant of less than about 6 percent may adversely affects the quality of the dispersion. After the film forming matrix polymer is formed, the polymer preferably comprises a carbonyl hydroxyl copolymer having a hydroxyl content of between about 1 weight percent and about 5 weight percent, based on the total weight of the terpolymer or tetrapolymer. Mixtures of the above polymers can also be used in any combination.

Any suitable solvent may be employed to dissolve the mixture of two film forming polymers utilized in the charge generating layer matrix of this invention. typical solvents include, for example, esters, ethers, ketones, mixtures thereof, and the like. Specific solvents include, for example, n-butyl acetate, cyclohexanone, tetrahydrofuran, methyl ethyl ketone, toluene, mixtures of methyl ethyl ketone and toluene, mixtures of tetrahydrofuran and toluene and the like.

Any suitable technique may be utilized to disperse the pigment particles in the solution of the two film forming polymers dissolved in a suitable solvent. Typical dispersion techniques include, for example, ball milling, roll milling, milling in vertical attritors, sand milling, and the like which utilize milling media. The solids content of the mixture being milled does not appear critical and can be selected from a wide range of concentrations. Typical milling times using a ball roll mill is between about 4 and about 6 days. If desired, the photoconductive particles with or without film forming binder may be milled in the absence of a solvent prior to forming the final coating dispersion. Also, a concentrated mixture of photoconductive particles and binder solution may be initially milled and thereafter diluted with additional binder solution for coating mixture preparation purposes. The resulting dispersion may be applied to the adhesive blocking layer, a suitable electrically conductive layer or to a charge transport layer. When used in combination with a charge transport layer, the photoconductive layer may be between the charge transport layer and the substrate or the charge transport layer can be between the photoconductive layer and the substrate.

Any suitable technique may be utilized to apply the coating to substrate to be coated. Typical coating techniques include dip coating, roll coating, spray coating, rotary atomizers, and the like. The coating techniques may use a wide concentration of solids. Preferably, the solids content is between about 2 percent by weight and 8 percent by weight based on the total weight of the dispersion. The expression "solids" refers to the pigment particle and binder components of the coating dispersion. These solids concentrations are useful in dip coating, roll, spray coating, and the like. Generally, a more concentrated coating dispersion is preferred for roll coating. Drying of the deposited coating may be effected by any suitable conventional technique such as oven drying, infra red radiation drying, air drying and the like.

Satisfactory results are achieved when the dried photoconductive coating comprises between about 40 percent and about 80 percent by weight of the photoconductive hydroxygallium phthalocyanine particles based on the total weight of the dried charge generating layer. When the pigment concentration is less than about 40 percent by weight, particle to the particle contact is lost resulting in deterioration. Optimum imaging performance is achieved when the charge generating layer comprises about 60 percent by weight of the photoconductive particles based on the total weight of the dried charge generating layer. Since the photoconductor characteristics are affected by the relative amount of pigment per square centimeter coated, a lower pigment loading may be utilized if the dried photoconductive coating layer is thicker. Conversely, higher pigment loadings are desirable where the dried photoconductive layer is to be thinner.

For multilayered photoreceptors comprising a charge generating layer and a charge transport layer, satisfactory results may be achieved with a dried photoconductive layer coating thickness of between about 0.1 micrometer and about 0 micrometers. Preferably, the photoconductive layer thickness is between about 0.2 micrometer and about 1 micrometer. Optimum results are achieved with a generating layer has a thickness of between about 0.3 micrometer and about 0.7 micrometer. However, these thicknesses also depend upon the pigment loading. Thus, higher pigment loadings permit the use of thinner photoconductive coatings. Thicknesses outside these ranges can be selected providing the objectives of the present invention are achieved.

The active charge transport layer may comprise any suitable activating compound useful as an additive dispersed in electrically inactive polymeric materials making these materials electrically active. These compounds may be added to polymeric materials which are incapable of supporting the injection of photogenerated holes from the generation material and incapable of allowing the transport of these holes therethrough. This will convert the electrically inactive polymeric material to a material capable of supporting the injection of photogenerated holes from the generation material and capable of allowing the transport of these holes through the active layer in order to discharge the surface charge on the active layer. An especially preferred transport layer employed in one of the two electrically operative layers in the multilayered photoconductor of this invention comprises from about 25 percent to about 75 percent by weight of at least one charge transporting aromatic amine compound, and about 75 percent to about 25 percent by weight of a polymeric film forming resin in which the aromatic amine is soluble.

The charge transport layer forming mixture preferably comprises an aromatic amine compound of one or more compounds having the general formula:

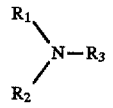

wherein $R_1$ and $R_2$ are an aromatic group selected from the group consisting of a substituted or unsubstituted phenyl group, naphthyl group, and polyphenyl group and $R_3$ is selected from the group consisting of a substituted or unsubstituted aryl group, alkyl group having from 1 to 18 carbon atoms and cycloaliphatic compounds having from 3 to 18 carbon atoms. The substituents should be free form electron withdrawing groups such as NO2 groups, CN groups, and the like.

Examples of charge transporting aromatic amines represented by the structural formulae above for charge transport layers capable of supporting the injection of photogenerated holes of a charge generating layer and transporting the holes through the charge transport layer include triphenylmethane, bis(4-diethylamine-2-methylphenyl)phenylmethane; 4'-4"-bis(diethylamino)-2',2"-dimethyltriphenylmethane, N,N'-bis(alkylphenyl)-[1,1'-biphenyl]-4,4'-diamine wherein the alkyl is, for example, methyl, ethyl, propyl, n-butyl, etc., N,N'-diphenyl-N,N'-bis(chlorophenyl)-[1,1'-biphenyl]-4,4'-diamine, N,N'-diphenyl-N,N'-bis(3"-methylphenyl)-(1,1'-biphenyl)-4,4'-diamine, and the like dispersed in an inactive resin binder.

Any suitable inactive resin binder soluble in methylene chloride or other suitable solvent may be employed in the process of this invention. Typical inactive resin binders soluble in methylene chloride include polycarbonate resin, polyvinylcarbazole, polyester, polyarylate, polyacrylate, polyether, polysulfone, and the like. Molecular weights can vary from about 20,000 to about 150,000.

Any suitable and conventional technique may be utilized to mix and thereafter apply the charge transport layer coating mixture to the coated or uncoated substrate. Typical application techniques include spraying, dip coating, roll coating, wire wound rod coating, and the like. Drying of the deposited coating may be effected by any suitable conventional technique such as oven drying, infra red radiation drying, air drying and the like.

Generally, the thickness of the hole transport layer is between about 10 to about 50 micrometers, but thicknesses outside this range can also be used. The hole transport layer should be an insulator to the extent that the electrostatic charge placed on the hole transport layer is not conducted in the absence of illumination at a rate sufficient to prevent formation and retention of an electrostatic latent image thereon. In general, the ratio of the thickness of the hole transport layer to the charge generator layer is preferably maintained from about 2:1 to 200:1 and in some instances as great as 400:1.

The preferred electrically inactive resin materials are polycarbonate resins have a molecular weight from about 20,000 to about 150,000, more preferably from about 50,000 to about 120,000. The materials most preferred as the electrically inactive resin material is poly(4,4'-dipropylidene-diphenylene carbonate) with a molecular weight of from about 35,000 to about 40,000, available as Lexan 145 from General Electric Company; poly(4,4-isopropylidene-diphenylene carbonate) with a molecular weight of from about 40,000 to about 45,000, available as Lexan 141 from the General Electric Company; a polycarbonate resin having a molecular weight of from about 50,000 to about 120,000, available as Makrolon from Farbenfabricken Bayer A. G. and a polycarbonate resin having a molecular weight of from about 20,000 to about 50,000 available as Merlon from Mobay Chemical Company. Methylene chloride solvent is a desirable component of the charge transport layer coating mixture for adequate dissolving of all the components and for its low boiling point.

Examples of photosensitive members having at least two electrically operative layers include the charge generator layer and diamine containing transport layer members disclosed in U.S. Pat. No. 4,265,990, U.S. Pat. No. 4,233,384, U.S. Pat. No. 4,306,008, U.S. Pat. No. 4,299,897 and U.S. Pat. No. 4,439,507. The disclosures of these patents are incorporated herein in their entirety. The photoreceptors may comprise, for example, a charge generator layer sandwiched between a conductive surface and a charge transport layer as described above or a charge transport layer sandwiched between a conductive surface and a charge generator layer.

Optionally, an overcoat layer may also be utilized to improve resistance to abrasion. In some cases an anti-curl back coating may be applied to the side opposite the photoreceptor to provide flatness and/or abrasion resistance where a web configuration photoreceptor is fabricated. These overcoating and anti-curl back coating layers are well known in the art and may comprise thermoplastic organic polymers or inorganic polymers that are electrically insulating or slightly semi-conductive. Overcoatings are continuous and generally have a thickness of less than about 10 micrometers. The thickness of anti-curl backing layers should be sufficient to substantially balance the total forces of the layer or layers on the opposite side of the supporting substrate layer. An example of an anti-curl backing layer is described in U.S. Pat. No. 4,654,284 the entire disclosure of this patent being incorporated herein by reference. A thickness between about 70 and about 160 micrometers is a satisfactory range for flexible photoreceptors.

A number of examples are set forth hereinbelow and are illustrative of different compositions and conditions that can be utilized in practicing the invention. All proportions are by weight unless otherwise indicated. It will be apparent, however, that the invention can be practiced with many types of compositions and can have many different uses in accordance with the disclosure above and as pointed out hereinafter.

EXAMPLE I

A dispersion was prepared by dissolving a film forming binder composition in cyclohexanone solvent and then adding hydroxygallium phthalocyanine pigment. The binder concentration, based on the total weight of binder in the solution was 100 percent by weight of a tetrapolymer reaction product of 81 weight percent vinyl chloride, 4 weight percent vinyl acetate, 0.28 weight percent maleic acid and 15 weight percent hydroxyethyl acrylate having a weight average molecular weight of about 35,000 (UCARMag 527, available from Union Carbide Co.). The pigment concentration in the dispersion was 20 percent by weight based on the total solids weight (pigment and binder). The dispersion was milled in a ball mill with ⅛ inch (0.3 cm) diameter stainless steel shot for 4 days. The dispersion was filtered to remove the shot and the solids content adjusted to 2 to 3 percent for coating. The average particle size of the milled pigment was about 0.07 micrometer. The dispersion quality of the coating mixture was examined. Next, the charge generating layer coating mixture was applied by a dip coating process in which a cylindrical 40 mm diameter and 310 mm long aluminum drum coated with a 0.1 micrometer thick zirconium silane coating was immersed into and withdrawn from the charge generating layer coating mixture in a vertical direction along a path parallel to the axis of the drum at a rate of 200 mm/min. The applied charge generation coating was dried by in oven at 106° C. for 10 minutes to form a layer having a thickness of approximately 0.3 micrometers. This coated charge generator layer was then dip coated with a charge transport mixture containing 36 percent N,N'-diphenyl-N,N'-bis (3methylphenyl)-1,1'-biphenyl-4,4'diamine and polycarbonate dissolved in monochlorobenzene solvent. The applied charge transport coating was dried by in a forced air oven at 118° C. for 25 minutes to form a layer having a thickness of 20 micrometers. The electrophotographic imaging member prepared was tested by electrically charging it at a field of 800 volts and discharging it with light having a wavelength of 780 nm. The dispersion properties of the coating mixture used to prepare the photoreceptor are summarized in the following table:

| Pigment/Binder Ratio Wt % | % Solids | Viscosity (cps) | Particle Size (micrometers) | Power Law Fit | Yld Pt. |
|---|---|---|---|---|---|
| 20 | 2.44 | 10.3 | 0.07 | 0.905 | 0 |

All particle size determinations were accomplished on a Horiba model capa 700 particle size distribution analyzer in the solvents used for the pigment milling step. The expression "power law" is obtained by plotting the viscosity against the shear rate and measuring the slope of the resulting line. A value that approximates 1 is indicative of a newtonian fluid, i.e exhibits no change in viscosity with increasing shear. The viscosity values are in centipoise units. The expression "yield point" is defined as the resistance to flow until a certain shear value is applied. A value approximating 0 has no yield point and is desirable for dip coating purposes. This yield point value demonstrates that no yield point is observed in this dispersion.

EXAMPLE II

The procedure described in Example I was repeated in the same manner except the pigment to binder ratio was changed to 40 weight percent pigment. The dispersion quality was measured to give the following values:

| Pigment/Binder Ratio Wt % | % Solids | Viscosity (cps) | Particle Size (micrometers) | Power Law Fit | Yld Pt. |
|---|---|---|---|---|---|
| 40 | 2.98 | 8.83 | 0.06 | 0.921 | 0 |

EXAMPLE III

The procedure of Example I was repeated except that the pigment to binder ratio was changed to 60 weight percent pigment and the dispersion quality was measured to give the following values:

| Pigment/Binder Ratio Wt % | % Solids | Viscosity (cps) | Particle Size (micrometers) | Power Law Fit | Yld Pt. |
|---|---|---|---|---|---|
| 60 | 3.46 | 8.77 | 0.06 | 0.908 | 0 |

EXAMPLE IV

The procedure of Example I was repeated except that the pigment to binder ratio was changed to 80 weight percent pigment and the dispersion quality was measured to give the following values:

| Pigment/Binder Ratio Wt % | % Solids | Viscosity (cps) | Particle Size (micrometers) | Power Law Fit | Yld Pt. |
|---|---|---|---|---|---|
| 80 | 3.24 | 6.54 | 0.06 | 0.908 | 0 |

Electrical evaluation of the above devices of Examples I through IV was made by charging to a voltage of 800 volts and measuring the photoinduced discharge at the exposures shown in the following table:

TABLE A

| % P:B | 20 | 40 | 60 | 80 |
|---|---|---|---|---|
| VH | 820 | 798 | 793 | 790 |
| VM 3.0 ergs | 575 | 298 | 122 | 104 |
| VM 7.0 ergs | 388 | 107 | 52 | 52 |
| VL 25.0 ergs | 216 | 68 | 42 | 44 |
| $X_{1/2}$ erg/cm$^2$ | 6.4 | 2.2 | 1.4 | 1.3 |
| Verase | 127 | 40 | 27 | 29 |

Vm(3erg) is the voltage resulting when a photoreceptor is charged to 800V and then exposed to 3 ergs/sq.cm. of light and is a measure of the photoresponse of the device. Similarly, a VM 7.0ergs and VL 25.0 ergs are the resultant voltages on the deiice after exposure to 7 and 25 ergs/cm$^2$ exposures. $X_{1/2}$ is the exposure necessary to reduce the voltage from $V_h$ to one half its value. Verase is the voltage remaining under the same test conditions but after an exposure of 300 ergs/sq.cm. and is sometimes referred to as the residual voltage, i.e. the device cannot be discharged with light to below this level.

EXAMPLE V

An electrophotographic imaging member was prepared as described in Example I using the same procedures and materials except that the cyclohexanone was replaced with a 50/50 mixture of toluene and methyl ethyl ketone and the UCARMag 527 in the binder component was replaced by a polymeric reaction product of 81 weight percent vinyl chloride, 4 weight percent vinyl acetate and 15 weight percent hydroxyethyl acrylate (VAGF available from Union Carbide). VAGF is a terpolymer having a weight average molecular weight of about 33,000. the dispersion properties of the coating mixture used to prepare the photoreceptor are summarized in the following table:

| Pigment/Binder Ratio Wt % | % Solids | Viscosity (cps) | Particle Size (micrometers) | Power Law Fit | Yld Pt. |
|---|---|---|---|---|---|
| 55 | 5.0 | 3.4 | 0.09 | 0.905 | 0 |

The power law value shows that the dispersion is close to Newtonian in flow properties. The viscosity values are in centipoise units. The yield point value demonstrates that this dispersion does not exhibit a yield point. Electrical tests of this photoreceptor are shown in the accompanying Table B.

TABLE B

| Optical Density (670 nm) | 0.39 | 0.45 | 0.49 | 0.57 | 0.64 | 0.73 |
|---|---|---|---|---|---|---|
| VO | 807 | 805 | 802 | 798 | 798 | 795 |
| Dark Decay | 13 | 15 | 16 | 18 | 19 | 20 |
| % Dark Decay | 2 | 2 | 2 | 2 | 2 | 3 |
| VH | 794 | 790 | 786 | 781 | 778 | 775 |
| VM 3.0 ergs | 167 | 132 | 99 | 69 | 72 | 65 |
| VM 7.0 ergs | 75 | 66 | 55 | 43 | 45 | 42 |
| VL 25.0 ergs (0.42) | 61 | 54 | 46 | 36 | 38 | 36 |
| $X_{1/2}$ [erg/cm^2] | 1.6 | 1.4 | 1.3 | 1.1 | 1.1 | 1.1 |
| Verase | 43 | 40 | 35 | 28 | 30 | 29 |

VM 3.0 ergs is the resultant voltage on the surface of the photoreceptor after 3 ergs/sq. cm. Exposure. Similarly, VM 7 ergs is the voltage after an exposure of 7 ergs/sq.cm. VL 25 ergs is the voltage after an exposure of 25 ergs/sq.cm. Verase is voltage remaining after an erase exposure of 300 ergs/sq cm. Other terminology used in the chart are: $X_{1/2}$ is the exposure energy required to discharge the photoreceptor to ½ the original voltage.

EXAMPLE VI

The procedure of Example III was repeated with the substitution of a terpolymer of vinyl chloride, vinyl acetate and vinyl alcohol (VAGH) in place of the UCAR527 with the following dispersion results:

| Pigment/Binder Ratio Wt % | % Solids | Viscosity (cps) | Particle Size (micrometers) | Power Law Fit | Yld Pt. |
|---|---|---|---|---|---|
| 60 | 8.9 | 29 | 0.26 | 0.971 | 0.681 |

This demonstrates that the hydroxyl function should be pendant to the carbon chain as in VAGF and not connected directly to the carbon spine as in this material. In addition a large number of particles were detected above 1 micron in the analysis. Poor coatings were obtained by dip procedures. A change to n-butyl acetate as solvent gave no improvement in dispersion quality for this material.

EXAMPLE VII

The procedure described in Example I was repeated in the same manner except the benzimide perylene pigment was substituted for the hydroxygallium phthalocyanine pigment. Although excellent pigment dispersions were obtained in UCARmag527, the xerographic electrical characteristics of the resulting photoreceptor were very poor.

Although the invention has been described with reference to specific preferred embodiments, it is not intended to be limited thereto, rather those having ordinary skill in the art will recognize that variations and modifications may be made therein which are within the spirit of the invention and within the scope of the claims.

What is claimed is:

1. An electrophotographic imaging member comprising a substrate, a charge generating layer and a charge transport layer, said charge generating layer comprising photoconductive hydroxygallium phthalocyanine particles dispersed in a polymer matrix, said matrix comprising a polymeric film forming reaction product of at least vinyl chloride, vinyl acetate and hydroxyalkyl acrylate.

2. An electrophotographic imaging member according to claim 1 wherein said film forming polymer matrix comprises a polymeric reaction product of reactants consisting essentially of said vinyl chloride, said vinyl acetate and said hydroxyalkyl acrylate.

3. An electrophotographic imaging member according to claim 2 wherein said film forming polymer matrix comprises a polymeric film forming reaction product of reactants consisting essentially of between about 80 percent and about 90 percent by weight of said vinyl chloride, between about 3 percent and about 15 percent by weight of said vinyl acetate and between about 6 percent and about 20 percent by weight of said hydroxyalkyl acrylate, based on the total weight of said reactants.

4. An electrophotographic imaging member according to claim 2 wherein said polymeric film forming reaction product is a solvent soluble polymer having a weight average molecular weight of at least about 15,000.

5. An electrophotographic imaging member according to claim 1 wherein said polymeric film forming reaction product has a weight average molecular weight of between about 15,000 and about 45,000.

6. An electrophotographic imaging member according to claim 1 wherein said film forming polymer matrix comprises a polymeric film forming reaction product of reactants consisting essentially of said vinyl chloride, said vinyl acetate, said hydroxyalkyl acrylate and less than about 1 percent by weight maleic acid, based on the total weight of said reactants.

7. An electrophotographic imaging member according to claim 6 wherein said film forming polymer matrix comprises a polymeric film forming reaction product of reactants consisting essentially of between about 80 percent and about 90 percent by weight of said vinyl chloride, between about 3 percent and about 15 percent by weight of said vinyl acetate, between about 6 percent and about 20 percent by weight of said hydroxyalkyl acrylate and between about 0.25 percent and about 0.38 percent by weight of said maleic acid, based on the total weight of said reactants.

8. An electrophotographic imaging member according to claim 2 wherein said polymeric film forming reaction product is a solvent soluble polymer having a weight average molecular weight of at least about 35,000.

9. An electrophotographic imaging member according to claim 1 wherein said polymeric film forming reaction product has a weight average molecular weight of between about 35,000 and about 50,000.

10. An electrophotographic imaging member according to claim 1 wherein said charge generating layer comprises between about 50 percent and about 65 percent by weight of said hydroxygallium phthalocyanine particles based on the total weight of said charge generating layer.

11. An electrophotographic imaging member according to claim 1 wherein said charge generating layer comprises about 60 percent by weight of said photoconductive particles based on the total weight of said charge generating layer.

12. An electrophotographic imaging member according to claim 1 wherein said photoconductive particles have an average particle size of less than about 1 micrometer.

13. An electrophotographic imaging member according to claim 1 wherein said photoconductive particles have an average particle size of less than about 0.1 micrometer.

14. An electrophotographic imaging member according to claim 1 wherein said generating layer has a thickness of between about 0.2 micrometer and about 1 micrometer.

15. An electrophotographic imaging member according to claim 1 wherein said generating layer has a thickness of between about 0.3 micrometer and about 0.7 micrometer.

16. An electrophotographic imaging member according to claim 1 wherein said charge generating layer is between said supporting substrate and said charge transport layer.

17. An electrophotographic imaging member according to claim 1 wherein said charge transport layer comprises charge transporting aromatic amine molecules.

18. An electrophotographic imaging member according to claim 1 wherein said film forming polymer matrix comprises a carbonyl hydroxyl copolymer having a hydroxyl content of between about 1 and about 5 weight percent based on the total weight of said copolymer.

* * * * *